United States Patent [19]

Voss et al.

[11] 4,072,271

[45] Feb. 7, 1978

[54] SELF-CLEANING BALL VALVE

[75] Inventors: Hubert E. Voss; Ronald W. Roth, both of Picacho, Ariz.

[73] Assignee: Irrigation Engineering & Specialties, Picacho, Ariz.

[21] Appl. No.: 296,958

[22] Filed: Oct. 12, 1972

[51] Int. Cl.[2] ..... B05B 1/32

[52] U.S. Cl. ..... 239/541; 239/569; 251/149.1

[58] Field of Search ..... 239/114, 116, 111, 569, 239/547, 117, 123, 572, 262, 201, 207, 230, 579; 251/149.1

[56] References Cited

U.S. PATENT DOCUMENTS

| | | | |
|---|---|---|---|
| 1,169,105 | 1/1916 | Allan | 251/149.1 |
| 1,427,105 | 8/1922 | Handlan, Jr. | 251/149.1 |
| 1,992,490 | 2/1935 | Lewis | 239/572 |
| 2,502,206 | 3/1950 | Creek | 251/149.1 |
| 2,571,583 | 10/1951 | Kolbach | 239/579 |
| 2,898,128 | 8/1959 | Shohan | 251/149.1 |

FOREIGN PATENT DOCUMENTS

| | | | |
|---|---|---|---|
| 382,280 | 10/1932 | United Kingdom | 239/541 |

*Primary Examiner*—Joseph F. Peters, Jr.
*Assistant Examiner*—Gene A. Church
*Attorney, Agent, or Firm*—Charles E. Cates

[57] ABSTRACT

An improvement on a ball valve for use in detachably connecting a riser pipe to an irrigation lateral. The novel valve has a throat operatively connected to the outlet end of the valve. The throat receives a valve trigger tube which has spaced fingers extending longitudinally from the end of the pipe to engage the ball, thereby forming apertures between the fingers which serve as a strainer to prevent the passage of foreign objects and which can be sized to regulate the flow of water. When the tube is withdrawn the flow of the water through the then open end of the tube generates a self-cleaning action.

2 Claims, 5 Drawing Figures

SELF-CLEANING BALL VALVE

FIELD OF THE INVENTION

This invention pertains to quick disconnect valves for use in connecting risers to irrigation laterals to commence the flow of water through the riser.

This invention has particularly useful application to connections for risers employing sprinkler heads.

BACKGROUND OF THE INVENTION

In the irrigation of crops, particularly lettuce, cotton and similar crops, pipes are extended laterally from main lines for the conduction of water. The laterals are built in portable sections which have means for connecting them end to end to form lateral runs of up to one-half mile. Typically each of the lateral sections has a 1inch pipe which is inserted into the lateral wall by means of threads and grooves and sealed with plumber's compound. The other end of the riser typically terminates in a sprinkler head, for example a "Rain Bird" sprinkler head which is rotated in a clock-wise direction by action of the water pressure on the sprinkler head mechanism.

A vexing problem is caused by the introduction into the irrigation water of foreign particles such as sand, grass, leaves and other debris which eventually clog the outlets of the sprinkler heads. When the sprinkler head is clogged with sediment and debris it must be cleaned to restore efficiency. This is a time consuming job. Therefore the foreign particles should be screened out before they reach the sprinkler head. Various devices in the prior art can be used to screen out these foreign particles including screens, meshes and sieve-like apertures. However, these devices must in turn be cleaned, often slowly and laboriously, to reopen the apertures for passage of water. The procedure is time consuming because each aperture must be individually cleaned out with a wire or the like.

Thus there is a need in the industry for an irrigation valve which is self-cleaning at the point of connection of the riser to the lateral to prevent the loss of time in periodic cleanings of the intake valve and the loss of efficiency when such valves and apertures are clogged with debris as above described.

An additional problem with prior art detachable valves is that they are bulky, difficult to store and to carry, and subject to breakage when loaded for carriage on a transport rack, which is the usual method of transportation from one site of use to another. In the industry it is often necessary to employ unskilled labor in the task of irrigating the fields. The workers often damage the prior art risers in the acts of assemblying, storing and transporting them. When a riser pipe is broken or damaged expense and equipment down-time are involved in repairing it. Moreover, the flow of water must be cut off at the main line when changes in the laterals for any purpose—e.g. repair or change of number of extensions—are made.

Some prior art valves are complex, having a number of moving parts such as hooks and springs and valve wheels which provide opportunities for malfunction and create an unwanted bulk in storage and transportation, and require distinct steps in hooking up the lateral and riser and turning on the flow of water.

Therefore, a further and additional need is the provision of a simplified detachable riser which can be handled easily by unskilled labor with a minimum of instructions on the function of the apparatus. This assembly should be easily portable and capable of being stored in a more compact space than heretofore found practicable for such assemblies, with a minimum exposure to breakage and malformation.

OBJECTS OF THE INVENTION

It is therefore a prime object of this invention to provide a self-cleaning device for straining debris out of the water.

It is a further object of this device to provide in combination with such straining device a means for regulating the rate of flow of water through the valve.

It is further an object of this invention to provide in combination with the foregoing features of this device a simplified valve which can be quickly and easily connected and disconnected and which will simultaneously with connection or disconnection automatically start and stop the flow of water through the valve.

It is further an object of this invention in combination with the foregoing device to provide a light-weight valve which makes it possible to store and transport risers and laterals on which the device is used more compactly and easily.

It has been discovered that the hereafter described improvement on the prior art ball valve makes it possible to combine in one device means for straining and regulating the flow of water which, upon disconnection, efficiently cleans itself of the accumulated debris from the apertures provided for straining the irrigation water.

It has further been discovered that the improvements provide a simplified detachable improved ball valve with a quick-disconnect device which turns the flow of water on and off simultaneously with the act of connecting or disconnecting, and which can be easily operated without special instruction, and which makes it possible to store and carry compactly without damage.

This invention combines an improvement over known types of ball valves. A ball valve as the term is used in this disclosure and as known to the prior art is a device which has a chamber with a ball inside the chamber, and spaced ports or apertures (smaller in diameter than the ball) through which water or other fluids enter and leave, or other suitable means for retaining the ball. The pressure of the fluid forces the ball against the seat disposed at the outlet of the chamber. The seat has an annular shape so that when the ball is seated the outlet is closed and the flow of fluid stops. The valve is opened by means of a finger which pushes the ball away from its seat, thus permitting the flow of water around the ball in the chamber and through the outlet.

BRIEF DESCRIPTION OF THE INVENTION

Briefly, this invention springs from the discovery that by providing an annular throat communicating with the outlet port of the valve chamber, and by providing a valve trigger made out of an annular tube sized to closely fit the inside of the throat, the water can be caused to flow through the hollow trigger, and further that by serrating the end of the trigger tube so that the end thereof has spaced longitudinally projecting fingers, these fingers can be caused to engage the ball and move it away from its seat, thereby forming ports which can be made to any pre-determined size for the purpose of straining water and controlling the rate of flow of the water. The serendipitous result is that when the hollow trigger is removed from the valve chamber the ports are no longer small holes which tenaciously retain the strained sediment and debris as in the prior art, but instead are open end slots which are self-cleaned by the action of the water falling out of a riser pipe through the now open end of the trigger tube. In most cases this makes it unnecessary to hand clean the trigger tube at all, and in rare instances when it is necessary to give additional attention to the end of the trigger tube it can be easily cleaned with a wiping motion over the slots.

This invention provides a rugged light-weight portable self-cleaning valve and coupling assembly for the connection of a riser to an irrigation lateral. The assembly permits rapid and almost fool-proof assembly without tools of lateral and risers without the necessity of cutting off the water flow at the main. Because of the easy detachability of riser and lateral, the two parts can be stored like a bundle of sticks in a very compact space and with a minimized exposure to breakage. With the advantage of using this device, a riser can be inserted into the lateral and locked with a twist, simultaneously commencing the flow of irrigation water. The riser can be quickly detached and removed by reversing the procedure, thereby simultaneously stopping the flow of water. A minimum of instruction in use is needed, making it feasible for use by unskilled labor.

The ball valve assembly is made in two pieces—one of which can be considered the valve chamber and the other a valve trigger. In a presently preferred embodiment the chamber is joined to a T-joint which provides access to the lateral and the trigger is fitted to the end of a riser. The valve chamber has a conduit communicating with the interior of the lateral pipe. At the first end of the conduit is an annular chamber which communicates with a narrower throat in the intermediate part of the conduit and in turn communicates with an annular recess in the other end of the conduit. In the chamber is a ball which is too large to pass through the throat and which, when water pressure is applied to the chamber through the first end of the conduit, is seated upon the rim of the neck in covering relationship to it. The force of the water urges the water against this seat and prevents the passage of the water through the throat. A perforated plate or like device placed over the first end of the conduit prevents the loss of the ball from the chamber.

At the second end of the conduit a second plate is placed over the end of the conduit. This plate has a slot and widens at the center to form a circular aperture at least as large as the larger diameter of the neck above referred to.

The trigger tube has an inlet and outlet end. The inlet end is inserted into the second end of the conduit at the valve housing. At the inlet end of the tube spaced projecting fingers extend longitudinally at or near the end of the outlet end. At least one radially projecting flange is provided, and it is sized and positioned on the outer surface of the tube so as to engage the recess at the second end of the housing and be held in place by the second plate. When the flange engages the recess in the housing, the projecting fingers will have urged the ball away from its seat in the chamber. The engagement of the ball by the fingers creates ports defined by the juxtaposition of the fingers and the ball and the amount of water flowing into the device can be controlled by the size and number of these ports. The inlet end of the tube is open and unobstructed when the ball is not engaged by the fingers. The outside diamter of the tube is sized to make it closely fit the inside diameter of the neck. Means are provided for making a water tight seal between the pipe and the neck or the pipe and the second chamber or both to prevent the passage of water other than through the apertures defined by the projecting fingers and ball in cooperation. The pipe has means for attaching a riser pipe to the outlet end. The attachment of the pipe to the riser and the attachment of the valve housing to the lateral may be either permanently or temporarily attached by friction fit or by means of grooves or threads all of which are well known to persons ordinarily skilled in the art. Although many known materials may be used to make the device of this invention, a polyvinyl chloride plastic is suitable. It is quite easy to join plastic risers to metal laterals in using this device.

DETAILED DESCRIPTION OF THE INVENTION

A better understanding of the details of this invention may be obtained from an examination of a presently preferred embodiment depicted in the drawings in which.

Figure 1:
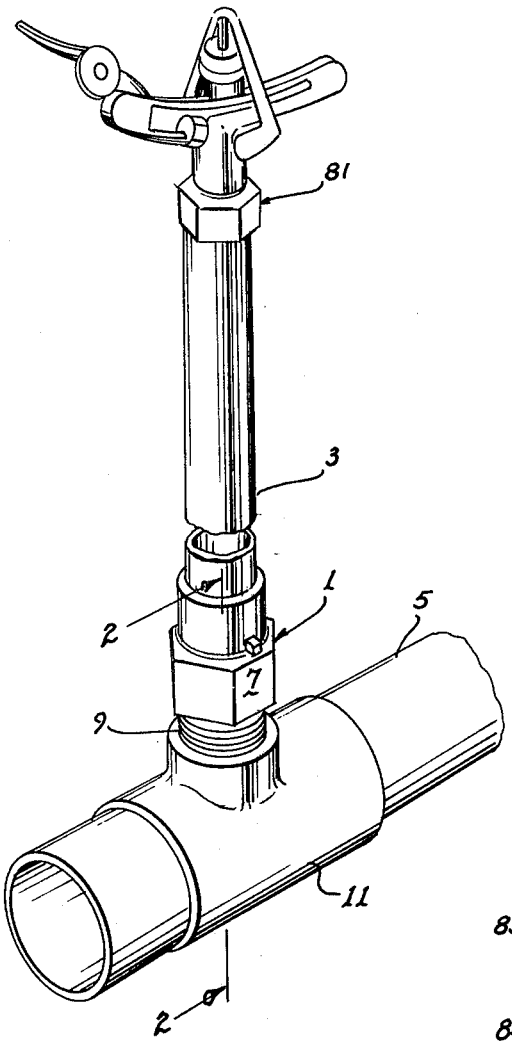
FIG. 1 is a perspective view of a riser connected to a section of lateral by means of the device of this invention.

In FIG. 1 the invention is placed in its environment. Here it is seen that the valve 1 connects the riser 3 to the lateral 5. The ball valve chamber 7 has been provided with threads and grooves 8 at its first end 9 to meet with similarly threaded and grooved T-joint 11. This joint is semi-permanent and may be sealed with plumber's compound if desired. Other alternative ways of fitting the ball valve 7 into the wall of the lateral 5 will occur to those skilled in the art. For example it might be accomplished with a friction fit and alternatively the first end of the ball valve chamber might be inserted directly into the wall of the lateral.

Figure 2:
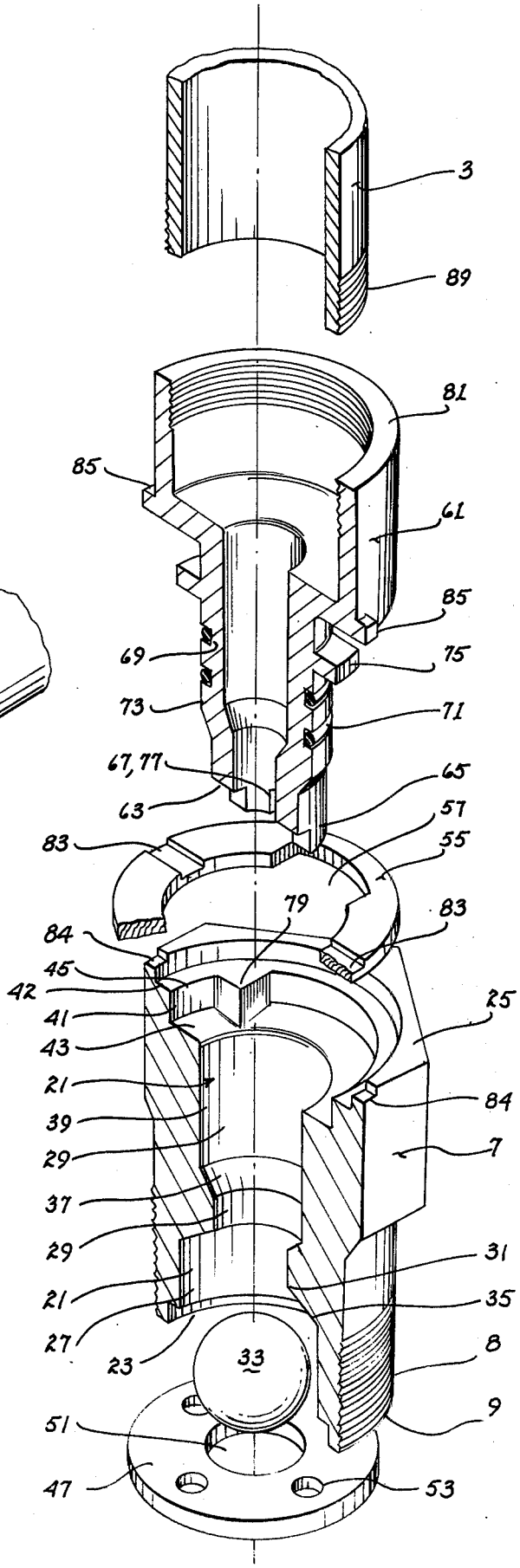
FIG. 2 is an exploded view of the elements of this invention, in section.
Figure 5:
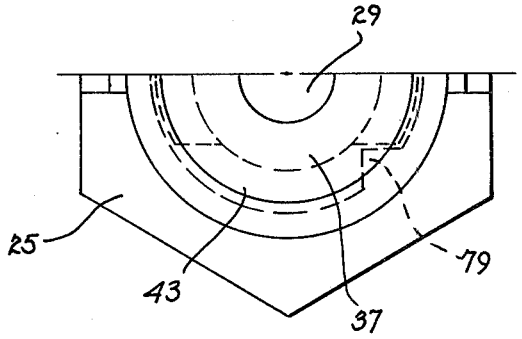
FIG. 5 is a plan view of the device of FIG. 3 taken along the lines 5—5.
Figure 3:
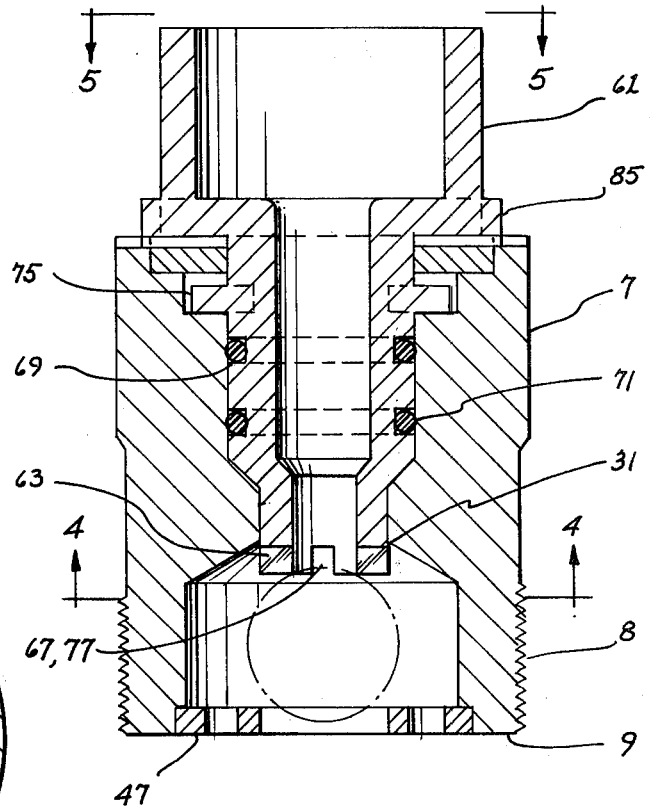
FIG. 3 is an elevation view of this device in section.
Figure 4:
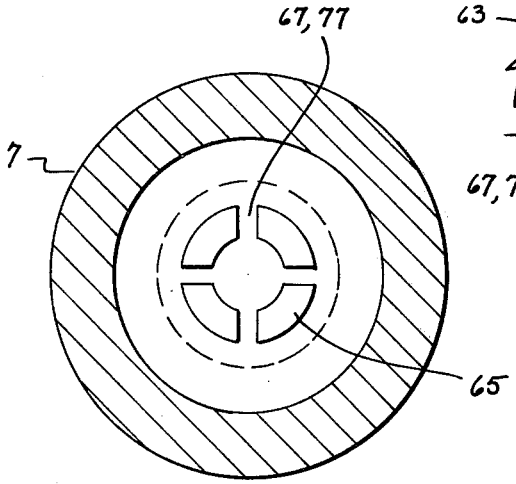
FIG. 4 is a plan view of the device of FIG. 3 taken along the lines 4—4.

The inner details of the preferred embodiment illustrated in the drawings may best be seen in FIG. 2.

As best shown in FIG. 2 the valve housing 7 has a conduit 21 with a first end 9 and a second end 25. At the first end of the conduit there is an annular chamber 27 which has a first diameter. There is an annular throat 29 communicating with the chamber and the second end of the conduit. This throat has a second diameter which is smaller than the first diameter. The restriction created by the throat presents a seat 31 which will engage a ball 33 and prevent its passage through the throat. The ball 33 has a diameter intermediate the diameters of the throat 29 and the chamber 27. The ball 33 resides within the chamber 27 where under the influence of water pressure from the lateral the ball 33 is forced against the seat 31, thus preventing the flow of water through the conduit 21. In this preferred embodiment the throat 29 has a narrowing frustoconical section 35 communicating between the throat and the chamber 27. An expanding frustoconical section 37 widens to an annular bore 39 having a third diameter. This recess has a floor 43 and an annular wall 45.

Turning again to the first end 23 of the conduit 21, attention is invited to the ball retainer means 47 which is recessed in the first end in covering relationship to the chamber. This means 45 has a discharging aperture 51 in its center for the passage of water. The aperture 51 is smaller than the diameter of the ball 33 in order to retain the ball within the chamber 27. Also provided are a plurality of small apertures 53 for use in providing drainage when the water pressure in the lateral is released. Thus, if the ball drops into the hole 51 and covers it, retained water cannot be trapped in the chamber. This avoids a problem in colder climates where freezing temperatures occur.

Considering again the second end of the conduit 41 it is observed that a plate 55 covers the second end. This plate is disposed over the annular recess 41 in covering relationship to the second end 25 of the conduit. This plate has an elongated slot 57 widened at its center portion 59 to provide a circular aperture as wide as the widest portion of the annular throat 29 (the bore 39 in this case).

The second major component of this device is the annular trigger tube 61 inserted into the housing 7. It has an inlet end 63 which has spaced fingers 65 extending longitudinally from the inlet end which define slots 67 therebetween.

When the spaced fingers 65 engage the ball 33 they form ports 77 which are sized to strain foreign particles which might clog the aqueduct (not shown) in the sprinkler head 81. The size and number of the ports 77 can also be adjusted to control the rate of flow of the water through the riser.

Flanges 75 radially extending from the outer surface of the tube 61 are spaced from the end 63 of the tube 61 so as to be engaged by a clock-wise twist between the floor 43 of the annular recess and plate 55 after the spaced fingers have engaged the ball and moved the ball into the first diameter chamber. The flange 75 is stopped at the proper place in its rotation by the tab 79. The tab 79 may be formed by building a stop on the wall 45 or the floor 43, or it may be formed by bending down a tab from the plate 55. The flange is retained in the recess in the proper position by the cooperative action of the tab 79, the plate 55 and the floor of the recess. "Rain Bird" sprinklers urge the sprinkler head 81 and the riser 3 in a clock-wise direction against the tab 79, thus holding the flanges 75 in place. This general type of connect and lock device is a bayonet joint.

The tube 61 is sized to closely fit the annular neck 29. Grooves 69 in the outer surface 73 of the pipe 61 are provided for the reception of "O" rings 71. The "O" rings provide a water tight seal between the neck 29 and the outer surface 73 of the pipe 61.

The plate 55 is cemented into the plate recess 42 and aligned for proper operation by visually registering channels 83 with channels 84.

The trigger tube 61 has an outlet end 81 which is provided with threads and grooves 85 which correspond to threads and grooves 89 in the end of the riser 3. Preferably these two are sealed by pipe joint compound. It should be observed that both the housing and the pipe can be joined to the lateral and the riser respectively by friction fits.

Although only one embodiment has been described, it may be appreciated that various equivalents within the scope and spirit of the invention, which is intended to be limited only by the scope of the attached claims, may occur to those skilled in the art.

What is claimed is:

1. In an irrigation pipe system, the improvements operatively associated therewith comprising a riser, a sprinkler head having an aqueduct of predetermined cross section, and a ball valve for controlling the outward flow of water through said system comprising:

a ball valve chamber remote from said sprinkler head;

a throat communicating with and conducting away from the outlet port of said valve chamber;

a valve trigger comprising a hollow tube sized to closely fit the inside of said throat, said tube having at one end longitudinally projecting spaced fingers such that when said trigger is inserted in said throat said fingers engage the ball and push it away from its seat, the fingers and ball in cooperation forming apertures individually smaller in cross section than said aqueduct in said sprinkler head to strain particles larger than said aqueduct, said trigger having an open end whereby upon being removed from said throat the spaces between said fingers are cleaned by the flow of water therethrough, and means for releasably connecting said trigger in open valve position.

2. The device of claim 1 wherein the means for releasably connecting said trigger in said open valve position is a bayonet joint.

* * * * *